US006520129B2

(12) United States Patent
Chiappini et al.

(10) Patent No.: US 6,520,129 B2
(45) Date of Patent: Feb. 18, 2003

(54) INTERNAL COMBUSTION ENGINE WITH AN HYDRAULIC SYSTEM FOR THE VARIABLE DRIVING OF VALVES AND A DOUBLE-PISTON TAPPET

(75) Inventors: Stefano Chiappini, Orbassano (IT); Andrea Pecori, Orbassano (IT); Francesco Vattaneo, Orbassano (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 0 days.

(21) Appl. No.: 10/102,750

(22) Filed: Mar. 22, 2002

(65) Prior Publication Data

US 2002/0152975 A1 Oct. 24, 2002

(30) Foreign Application Priority Data

Mar. 23, 2001 (IT) ..... TO01A0270

(51) Int. Cl.[7] ..... F01L 9/02; F01L 13/00

(52) U.S. Cl. ..... 123/90.12; 123/90.16; 123/90.49

(58) Field of Search ..... 123/90.12, 90.13, 123/90.15, 90.16, 90.48, 90.49

(56) References Cited

U.S. PATENT DOCUMENTS

| | | | | | |
|---|---|---|---|---|---|
| 5,127,375 | A | * | 7/1992 | Bowman et al. | 123/90.12 |
| 5,263,441 | A | * | 11/1993 | Rembold et al. | 123/90.12 |
| 6,138,621 | A | * | 10/2000 | Albanello et al. | 123/90.12 |
| 6,192,841 | B1 | * | 2/2001 | Vorih et al. | 123/90.12 |
| 6,227,154 | B1 | * | 5/2001 | Wakeman | 123/90.16 |
| 6,321,701 | B1 | * | 11/2001 | Vorih et al. | 123/90.12 |
| 6,325,028 | B1 | * | 12/2001 | Albanello et al. | 123/90.12 |
| 6,386,160 | B1 | * | 5/2002 | Meneely et al. | 123/90.16 |
| 6,412,457 | B1 | * | 7/2002 | Vorih et al. | 123/90.12 |

* cited by examiner

*Primary Examiner*—Weilun Lo
(74) *Attorney, Agent, or Firm*—Sughrue Mion, PLLC

(57) ABSTRACT

In an internal combustion engine comprising an hydraulic system for the variable driving of valves, one tappet comprises two separate piston sections that are connected to two distinct pressure chambers, which control the driving pistons of two separate valves of the same engine cylinder.

2 Claims, 2 Drawing Sheets

INTERNAL COMBUSTION ENGINE WITH AN HYDRAULIC SYSTEM FOR THE VARIABLE DRIVING OF VALVES AND A DOUBLE-PISTON TAPPET

BACKGROUND OF THE INVENTION

The presents invention relates to internal combustion engines of the type comprising:

at least one intake valve and at least one exhaust valve per cylinder, each equipped with respective return spring devices that bring the valve back to the closed position in order to control communication between their corresponding intake and exhaust manifolds and the combustion chamber;

one camshaft to drive the intake and exhaust valves of the engine cylinders by means of appropriate tappets;

in which at least one of said tappets drives its respective intake or exhaust valve by effect of the movement of the above return spring devices through the operation of hydraulic devices, which include a pressurized fluid chamber.

Said pressurized fluid chamber can be connected to an outlet, by means of a solenoid valve, so as to disconnect the valve from its respective tappet, thus causing the valve to close rapidly by effect of the movement of the corresponding return spring devices.

Said hydraulic devices also comprise a piston joined to the valve stem and mounted so as to slide inside a guide bushing; said piston opens onto a variable volume chamber, which is formed by the piston inside the guide bushing; said variable volume chamber communicates with the pressurized fluid chamber through an opening at the end of the guide bushing; said piston has an end piece that is suitable for insertion inside said opening at the end of the guide bushing, at the end of the closing stroke of the valve, in order to reduce the opening for communication between said variable volume chamber and said pressurized fluid chamber, thus checking the valve's stroke close to its closing point.

The type of engine specified above is described and illustrated in the applications for European patent, EP-A-0 803 642 and EP-A-1 091 097 filed by the same Requesting Company.

For the above type of engines, it has already been proposed that two valves of the same engine cylinder, e.g. two intake valves or two exhaust valves, be driven by the same cam of the engine distribution shaft.

This problem is usually solved mechanically by mounting a small plate that works in unison with the driving cam, which is, in turn, functionally connected to two tappets that are joined to the valves to be controlled. This solution creates problems in the structure of the engine, also resulting in larger (engine) dimensions and higher costs. In theory, it is possible to provide for a single tappet, connected to the above pressure chamber, and then hydraulically connect the pressure chamber to the chambers that are connected to the driving pistons of the two valves. However, this is not the best solution because it entails a considerable increase in the volume of the hydraulic circuit for driving the valves, to the detriment of the system's elasticity and making it impossible to work at high engine r.p.m.

SUMMARY OF THE INVENTION

The purpose of the present invention is to solve the above problem in a satisfactory manner by applying simple, economic means, which would make it possible to simultaneously control two valves of the same engine cylinder through the same distribution shaft cam.

With a view to achieving this objective, the subject of this invention is an engine with all the characteristics specified in the introduction, which is also characterized in that the above-cited tappet comprises two separate piston sections that are connected to two distinct pressure chambers; these chambers control the driving pistons of two valves of the same engine cylinder.

In one of its preferred arrangements, the above tappet has a cylindrical body with a first piston section of larger diameter and a second piston section of smaller diameter mounted so that they slide inside the corresponding sections of a cylindrical guide bushing; said piston section of smaller diameter opens onto a pressure chamber, which is located at its end. The second pressure chamber consists of a ring-shaped cavity formed inside the portion of the guide bushing of larger diameter by the section of the body of the tappet of smaller diameter. The above two pressure chambers are connected by separate manifolds to the two driving pistons of the valves to be controlled.

Thus, thanks to the characteristics described above, the invention ensures that two valves of the same engine cylinder are driven, starting from a same cam of the distribution shaft, without entailing any problems of construction nor requiring any substantial increase in the volume of the hydraulic circuit for driving the valves. This makes it possible to implement a system with comparably high rigidity, which is therefore capable of responding appropriately even when the engine operates at high r.p.m.

BRIEF DESCRIPTION OF THE DRAWINGS

Additional characteristics and advantages of this invention are described below, with reference to the attached drawings, which are merely provided as exemplification without limitation, in which.

DETAILED DESCRIPTION OF THE INVENTION

Figure 1:
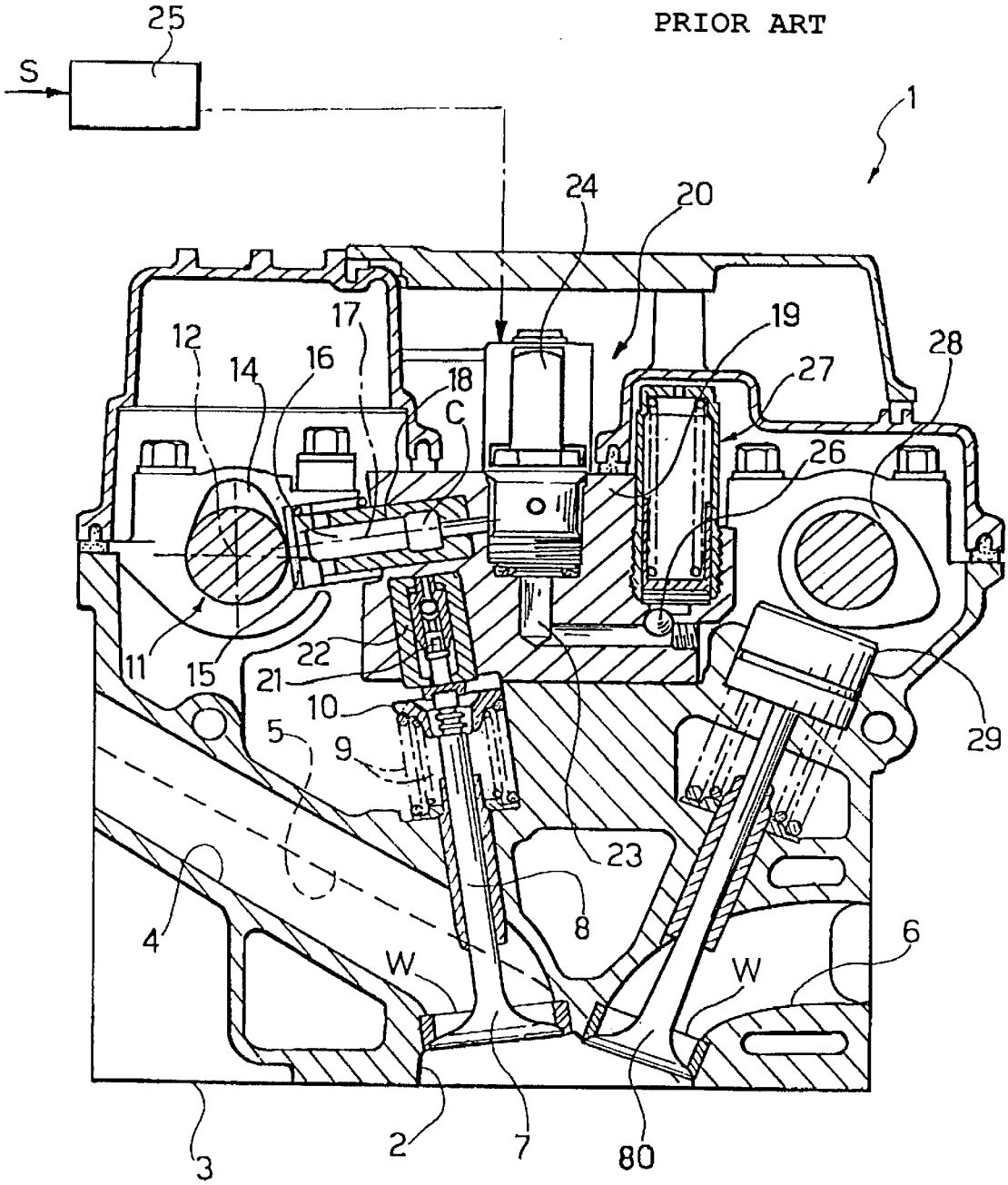
FIG. 1 PRIOR ART
FIG. 1 is a sectional view of the head of an internal combustion engine as designed in the application for European patent, EP-A-0 803 642 filed by the same Requesting Company.

With reference to FIG. 1, the internal combustion engine described in the above-mentioned application for European patent, EP-A-0 803 642, and in application EP-A-1 091 097, filed by the same Requesting Company, is a multi-cylinder engine, e.g. a five-cylinder, in-line engine, which includes a cylinder head 1.

The head 1 comprises, for each cylinder, a cavity 2 formed in the basic area 3 of the head, which forms the combustion chamber, into which two intake manifolds 4, 5 and two exhaust manifolds 6 flow. Communication between the two intake manifolds 4, 5 and the combustion chamber 2 is controlled by two intake valves 7 of the conventional type with head, each comprising a stem 8, which is mounted so as to slide inside the body of the head 1. Each valve 7 is brought back to the closing position by return springs 9, which are placed between one of the internal surfaces of the head 1 and an end cup 10 of the valve.

The opening of the intake valves 7 is controlled by a camshaft 11, which is mounted so as to rotate around an axis 12 inside the head 1 supports, and which includes a plurality of cams 14 for driving the valves, as described below.

Each control cam 14 of the intake valve 7 works in unison with the plate 15 of one tappet 16 that is mounted so as to slide along an axis 17, which, in the case illustrated, is essentially aimed 90° with respect to the axis of the valve 7 (the tappet can also be mounted in line with the axis, as is illustrated in FIG. 3), inside a bushing 18 mounted on the body 19 of a pre-assembled subassembly 20. This subassembly includes all the electric and hydraulic devices associated with the driving of the intake valves, as described in detail below. The tappet 16 is capable of transmitting a thrust to the stem 8 of the valve 7 so as to cause the latter valve to open as a result of the movement of the return springs 9 by means of the pressurized fluid (usually this fluid is oil coming from the engine's lubrication circuit), which contained in a chamber C, and a piston 21, which is mounted so as to slide inside a cylindrical body, composed of a bushing 22; the bushing is also mounted on the body 19 of the subassembly 20. As part of this same solution, shown in FIG. 1, the pressurized fluid chamber C connected to each intake valve 7 can be connected to an outlet 23 by a solenoid valve 24. The solenoid valve 24, which can be of any known type and is suited to the function illustrated herein, is controlled by the electronic control devices, schematically indicated as 25, on the basis of the signals S, which indicate the engine's operating parameters, e.g. the position of the accelerator and the number of engine r.p.m. When the solenoid valve 24 is opened, the chamber C interacts with the outlet 23, so that the pressurized fluid contained in the chamber C flows into said outlet, resulting in the uncoupling of the tappet 16 of the respective intake valve 7; the valve is brought quickly to its closing position by the movement of the return spring 9. By controlling communication between the chamber C and the outlet 23, it is possible to vary the (opening) time and stroke of each intake valve 7 at will.

The outlets 23 of the various solenoid valves 24 all flow into the same longitudinal outlet 26, which communicates with one or more pressure accumulators 27, of which only one is visible in FIG. 1. All the tappets 16 and corresponding bushings 18, the pistons 21 and corresponding bushings 22, the solenoid valves 24 and relative outlets 23, 26 are derived and mounted on the above body 19 of the pre-assembled subassembly 20, thus enhancing the simplicity and rapidity of engine assembling.

The exhaust valves 80, which are connected to each cylinder, as illustrated in FIG. 1, are controlled in the conventional manner by a camshaft 28 by means of the corresponding tappets 29.

Figure 2:
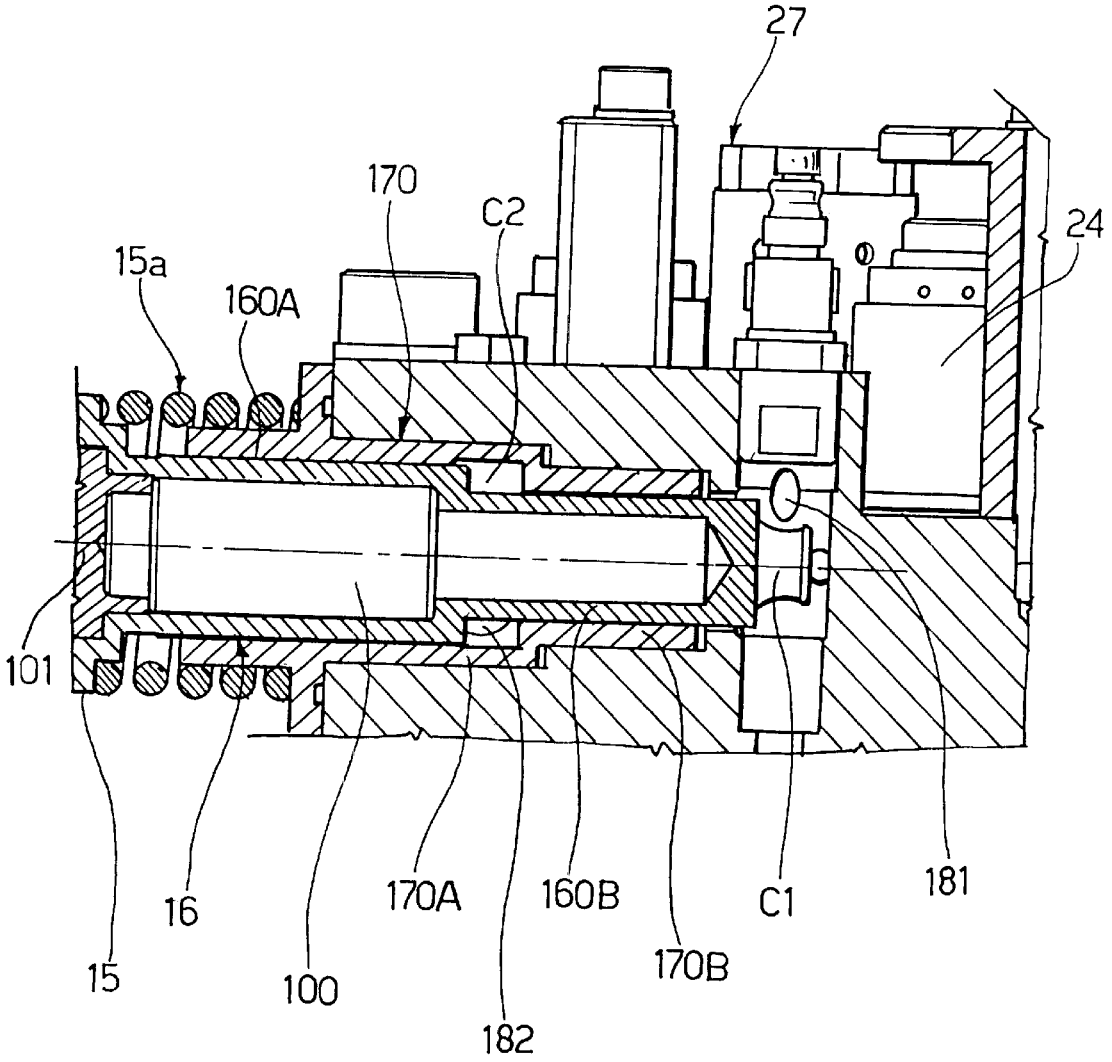
FIG. 2 is an enlarged sectional view of the detail relevant to the tappet, which has been modified on the basis of the present invention.

FIG. 2 shows an enlarged view of the body 19 of the pre-assembled subassembly.

FIG. 2 also contains an enlarged detail of an engine tappet, which has been modified in accordance with the present invention. In the case of the example shown in FIG. 2, the tappet 16 has a tubular body with a blind parallel hole 100 with a head at its end, forming the plate 15, which, in the example shown, is closed by a disk 101; the disk is mounted inside the end opening of the tubular body of the tappet 16. As can also be seen in FIG. 2, the first portion 160A of the tubular body of the tappet 16 has a larger diameter near the plate 15, and the second portion 160B has a smaller diameter, which forms the end of the tappet 16, opposite the plate 15. The tappet 16 is mounted so as to slide inside a guide bushing 170, of which the first portion 170A has a larger diameter, inside which the portion with larger diameter 160A of the tappet 16 is mounted so as to slide, and (it has) a portion with smaller diameter 170B, inside which is mounted the portion with smaller diameter 160B of the tappet 16.

The portion of the tappet 16 of smaller diameter 160B makes up a first piston, which is connected to a pressure chamber C1. The portion of the tappet 16 of larger diameter 160A also makes up a piston, to which a second pressure chamber C2 is connected; this chamber consists of a ring-shaped cavity, which is formed inside the portion of larger diameter 170A of the guide bushing 170 by the portion of the tappet 16 of smaller diameter 160B.

The two pressure chambers C1, C2 are connected through their respective outlets 181, 182, which are only partially visible in FIG. 2, to the chambers connected to the two pistons 21 of the type shown in FIG. 1, for driving the two corresponding valves (e.g. two intake valves or two exhaust valves), which are connected to the same cylinder of the engine.

During engine operation, the cam that works in unison with the plate 15 of the tappet 16, shown in FIG. 2, cyclically pushes the tappet toward the right (with reference to FIG. 2), as a result of the movement of the spring 15*a*. This movement results in an increase in the oil pressure inside the pressure chambers C1, C2 from the two piston sections 160A, 160B of the tappet. The pressurized oil is thus sent to the chambers connected to the two pistons for driving the valves to be controlled, without the need to perform any additional mechanical or construction work on the engine and without entailing any substantial increase in the volume of the hydraulic circuit, thus obtaining the advantages mentioned above.

In this way, each cam is capable of driving two valves, whose movements can be kept separate; this is because each chamber is connected to a solenoid valve, which can be separately driven.

What is claimed is:

1. An internal combustion engine composed of:

at least one intake valve and at least one exhaust valve per cylinder, each one equipped with its respective return spring devices, which bring the valve back to the closed position, in order to control communication between the corresponding intake and exhaust manifolds and the combustion chamber;

one camshaft for driving the intake and exhaust valves of the engine cylinders by means of the corresponding tappets;

in which at least one of the above-mentioned tappets drives its corresponding intake or exhaust valve by effect of the movement of said return springs, through the operation of hydraulic devices that include a pressurized fluid chamber;

said pressurized fluid chamber may be connected to an outlet through a solenoid valve so as to uncouple the valve from its respective tappet, thus causing the valve to close rapidly as a result of the movement of the corresponding return spring devices;

said hydraulic devices also comprise a piston that is connected to the stem of the valve and mounted so as to slide inside a guide bushing; said piston faces a variable volume chamber, which is formed by said piston and the guide bushing; said variable volume chamber communicates with the pressurized fluid chamber through an opening at the end of said guide bushing; said piston has an end piece that is suitable for insertion inside said end opening at the end of the closing stroke of the valve, in order to reduce the opening for communication between said variable volume chamber and said pressurized fluid chamber, thus checking the valve's stroke close to its closing point;

wherein the above tappet comprises two separate piston sections that are connected to two separate pressure chambers, which control the pistons for driving two distinct valves of a same engine cylinder.

2. Internal combustion engine according to claim 1, wherein the above tappet has a cylindrical body with a first piston section of a larger diameter, and a second piston section of a smaller diameter, which are mounted so as to slide inside corresponding sections of a cylindrical guide bushing; said piston section of smaller diameter looks onto one of said pressure chambers, which is placed at its end; the second pressure chamber consists of a ring-shaped cavity, which is formed inside the section of larger diameter of the guide bushing by the section of smaller diameter of the body of the tappet.

* * * * *